US007748524B2

(12) United States Patent
Ruzumna

(10) Patent No.: US 7,748,524 B2
(45) Date of Patent: Jul. 6, 2010

(54) PAINT BRUSH CLEANER AND METHOD

(76) Inventor: Edward Ruzumna, 3974 Winterset Ct., West Bloomfield, MI (US) 48323

( * ) Notice: Subject to any disclaimer, the term of this patent is extended or adjusted under 35 U.S.C. 154(b) by 50 days.

(21) Appl. No.: 11/998,640

(22) Filed: Dec. 3, 2007

(65) Prior Publication Data

US 2009/0139042 A1 Jun. 4, 2009

(51) Int. Cl.
*B08B 3/04* (2006.01)
*B65D 81/00* (2006.01)

(52) U.S. Cl. ..... 206/209; 134/201; 134/900; 206/209.1; 401/131

(58) Field of Classification Search ..... 134/201, 134/900; 206/209, 209.1; 401/131
See application file for complete search history.

(56) References Cited

U.S. PATENT DOCUMENTS 3,918,582 A * 11/1975 Wallace ..... 206/362
3,955,670 A * 5/1976 Buslik ..... 206/15.3
4,108,509 A * 8/1978 Piet et al. ..... 312/1
4,448,209 A * 5/1984 Lindsay ..... 134/141
4,865,188 A * 9/1989 Custeau ..... 206/209
5,016,791 A * 5/1991 Burow ..... 224/148.6
5,540,363 A * 7/1996 Wilson ..... 224/148.7
2004/0003835 A1* 1/2004 Higgins ..... 134/138
2005/0029297 A1* 2/2005 Hughes ..... 222/158
2005/0044725 A1* 3/2005 Alliss ..... 30/276

FOREIGN PATENT DOCUMENTS

GB 2069829 A * 9/1981

* cited by examiner

*Primary Examiner*—Joseph L Perrin
*Assistant Examiner*—Benjamin Osterhout
(74) *Attorney, Agent, or Firm*—Alex Rhodes

(57) ABSTRACT

An apparatus for cleaning a paint brush and preventing a discharge of harmful and flammable vapors. In a first embodiment, a housing has vertical front, side and rear walls that have upper edge portions in a common horizontal plane for providing a seat for a seal. The common upper of the housing are sealed by a soft resilient cellular seal and a cover that engages the housing. The cover and resilient cellular seal have aligned apertures for receiving in a pass through sealing relationship a handle of a paint brush. In a second embodiment, a cylindrical housing has an open top portion which is sealed by threadably engaging a cover with a resilient cellular seal therebetween. The cover and resilient cellular seal cover have aligned apertures for receiving in a pass through sealing relationship a handle of a paint brush.

12 Claims, 7 Drawing Sheets

PAINT BRUSH CLEANER AND METHOD

FIELD OF THE INVENTION

This invention relates to paint brushes and more particularly to an apparatus for cleaning and preserving the life of a paint brush and preventing discharges of toxic vapors into the environment.

BACKGROUND OF THE INVENTION

Clean, well maintained paint brushes produce quality finishes free of runs and bristles. Cleaning is tedious and time consuming. Fluids used for cleaning are often discarded into the environment after only a single or several uses. Many fluids are volatile, fire hazards and contaminate ground water, lakes and streams.

Numerous procedures and devices for cleaning brushes exist in the art. The most common procedure consists of washes in solvents and soapy water. After cleaning, brushes are often stored on their sides or upright on their ends, causing paint to harden in bristles and bristles to deform.

Awareness of the fire and health hazards with cleaning solvents has resulted in government regulations. Flammable fluids must be isolated in business establishments from ignition sources. Commercial clothes cleaners are required by law to confine cleaning fluids in closed systems that prevent a discharge of hazardous vapors into the environment. As yet, the use of hazardous solvents by commercial painters and consumers is largely unregulated. Consequently, painters and consumers carelessly pollute ground water, lakes and streams by dumping hazardous solvents on the ground and into sinks and sewers.

Existing brush cleaning apparatus and storage devices are difficult to use and difficult to seal. An effective, easy to use apparatus for cleaning and storing paint brushes would satisfy an important public need.

SUMMARY OF THE INVENTION

A primary object of the present invention is to provide an effective, easy to use method and device for cleaning and preserving paint brushes. Another object is to control the discharge of toxic and flammable vapors into the environment. Another object is to decrease the use of liquid solvents that emit toxic vapors.

The invention lies in features which individually and collectively provide an easy to use apparatus for cleaning and preserving paint brushes and preventing discharges of toxic and flammable vapors into the environment. One characteristic feature of the invention is a thick compressible gasket which makes the invention easy to use and seal. Another important feature is that the invention can have a variety of shapes.

In a first aspect of the invention a cleaning apparatus is sealed by fixing a cover to a housing by engaging a pair of resilient tabs on a cover with ribs on the housing. During the fixing of the cover to the housing, a thick gasket between the cover and the housing is compressed. In a second aspect of the invention the cover is fixed to the housing by threadably engaging the cover with the housing. In a third aspect of the invention, the cover is fixed to the housing by engaging an outwardly extending projection on the housing with an inverted "J-slot" on the cover. In a fourth aspect of the invention, the cover completely encloses a handle of a paintbrush. In all of the aspects a thick gasket between a cover and a housing is compressed.

In employing the teaching of the present invention, alternate constructions can be adopted to achieve the desired results and capabilities. In this disclosure, although several embodiments are disclosed, the disclosed embodiments are intended as examples only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating preferred features of the invention by way of non-limiting examples only.

DETAILED DESCRIPTION OF A PREFERRED EMBODIMENT

Figure 1:
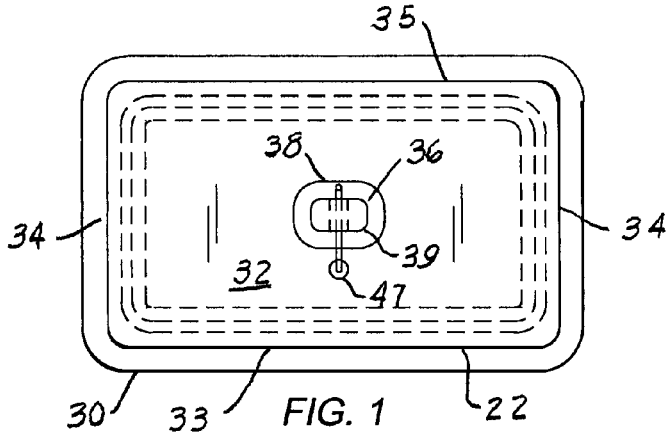
FIG. 1 is a plan view of a paint brush and holder according to the present invention.
Figure 2:
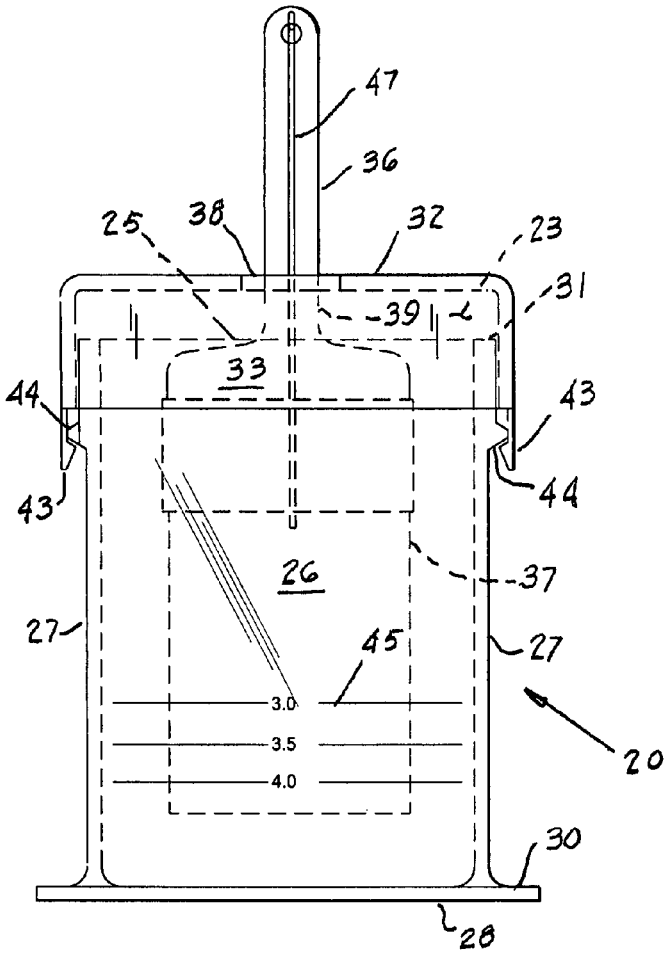
FIG. 2 is a front view of the paint brush and holder.
Figure 3:
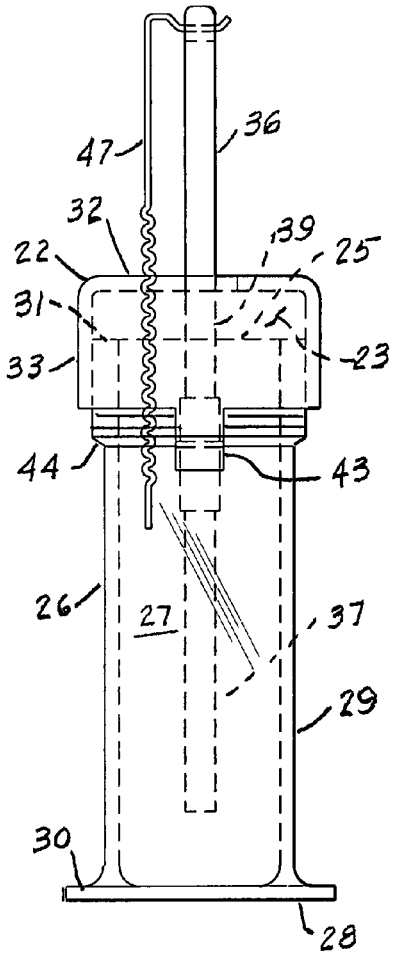
FIG. 3 is a left side view of the paint brush and holder.

Referring now to the drawings wherein like numerals designate like and corresponding parts throughout the several views, in FIGS. 1 through 3, a brush cleaning apparatus is shown according to the present invention. One benefit of the cleaning apparatus 20 is that it prevents toxic vapors from discharging into the environment. Another benefit is that it reduces the use of flammable and toxic paint solvents. One feature of the invention is that it can be used to clean a variety of brush sizes. Another feature is that it can have a variety of shapes. Another feature is that space is provided for capturing paint that is expelled from the brush.

The paint brush cleaning apparatus 20 is comprised of a housing 21, a cover 22, a gasket 23 and an optional support post 47. In a preferred embodiment, the housing 21 has an open top and parallel vertical front 26, side 27, bottom 28 and rear 29 walls. The relationships between the housing 21, cover 22, gasket 23 and an optional support post 24 of the cleaning apparatus 20 is best understood by reference to the exploded view in FIG. 7.

Extending outwardly from the bottom wall 28 is an optional short flange 30. One requirement of the preferred embodiment 20 is that the upper edges 31 of the front 26, side 27 and rear 29 walls lie in a horizontal sealing plane. The upper edges 31 of the vertical walls 26, 27, 28, 29 can deviate from this requirement somewhat at the expense of increased cost and complexity. As shown in FIGS. 1 through 3, the housing 21 has a generally rectangular shape.

Referring to FIGS. 1 through 3 and 7, fixed to the top of the housing 21 in sealing relationship is a rectangular shaped cover 22. The cover 22 has an upper wall 32 that encloses the open top 25 of the housing and vertical front 33, side 34 and rear 35 walls that extend downwardly from the upper wall 32 and surround the upper portions of the front 26, side 27 and rear 29 walls of the housing 21. The cover 22 and housing 21 are preferably molded from existing polymers that are chemically resistant to paint brush cleaning solvents.

Figure 11:
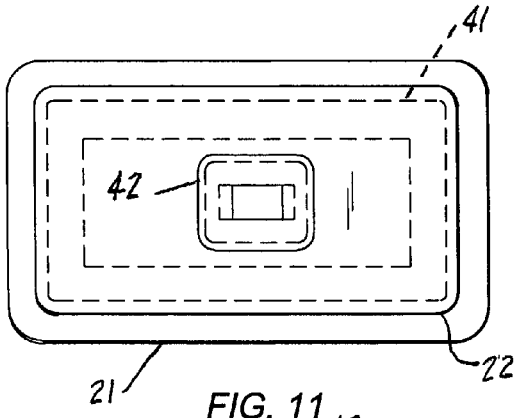
FIG. 11 is a plan view of an alternate embodiment of the paint brush holder.
Figure 12:
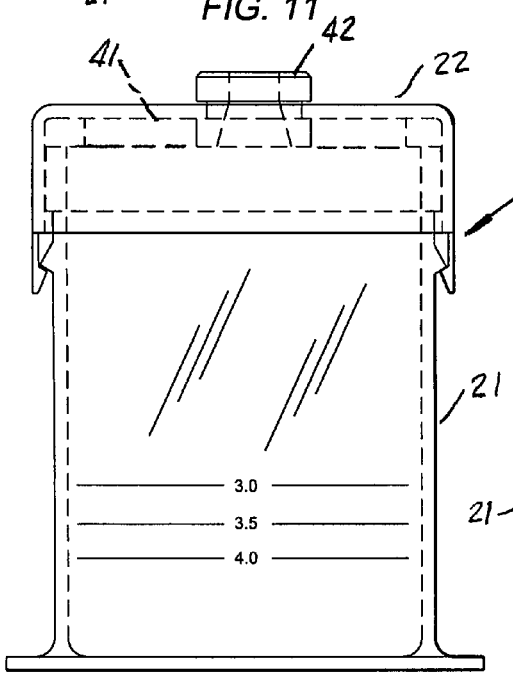
FIG. 12 is a front view of the alternate embodiment.
Figure 13:
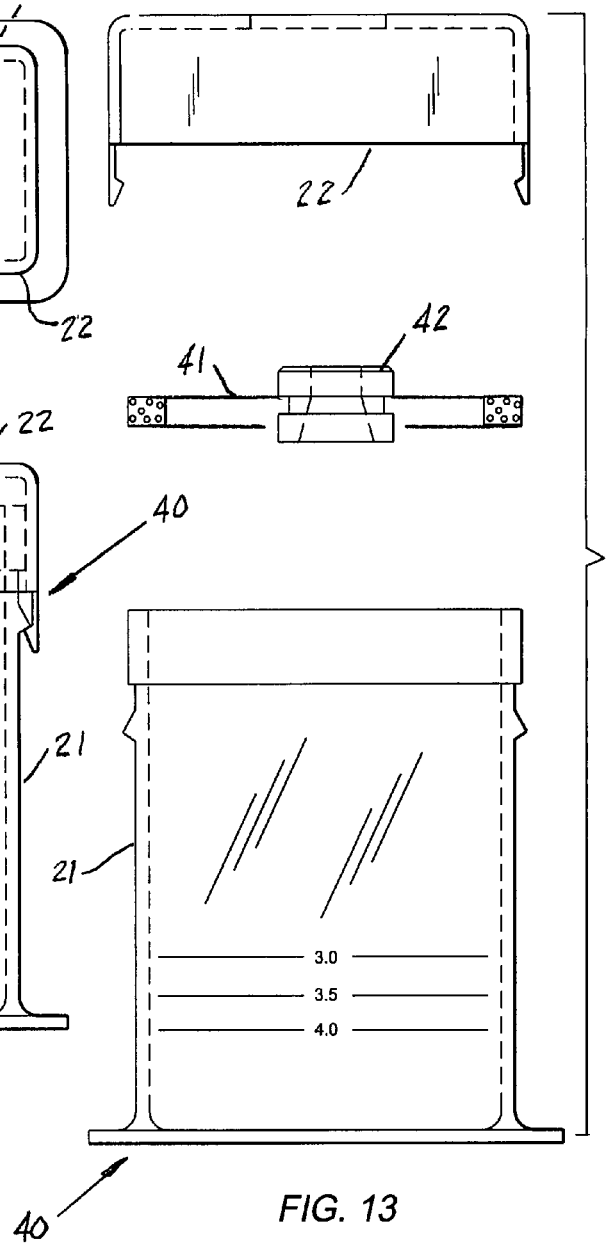
FIG. 13 is an exploded view of the alternate embodiment.

Between the cover 22 and the housing 21 is a thick resilient gasket 23 that seals the cover 22 to the housing 21 and a handle 36 of a paint brush 37 that extends upwardly out of the cleaning apparatus 20. The gasket 23 is preferably a uniform thickness layer of a closed cell polymer that is easily compressed and chemically resistant to paint brush cleaning solvents. One acceptable material is cross-linked polyethylene which is available in different levels of compressibility. The gasket 23 is preferably attached with an adhesive to the underside of the cover upper wall 32 and extends across the length and width of the cover 22. In the center of the gasket 23 and upper wall 32 of the cover 22 are apertures 38, 39 through which the handle 36 of the brush 37 passes. The portion of the gasket 23 that surrounds the paint brush handle 36 grips the handle 36 with a force that is sufficient to seal the handle 36 with the cover 22. In FIGS. 11 through 13, an embodiment 40 is shown wherein a gasket 41 with an open center portion and grommet 42 are substituted for the one piece gasket in FIGS. 1 through 7.

Figure 7:
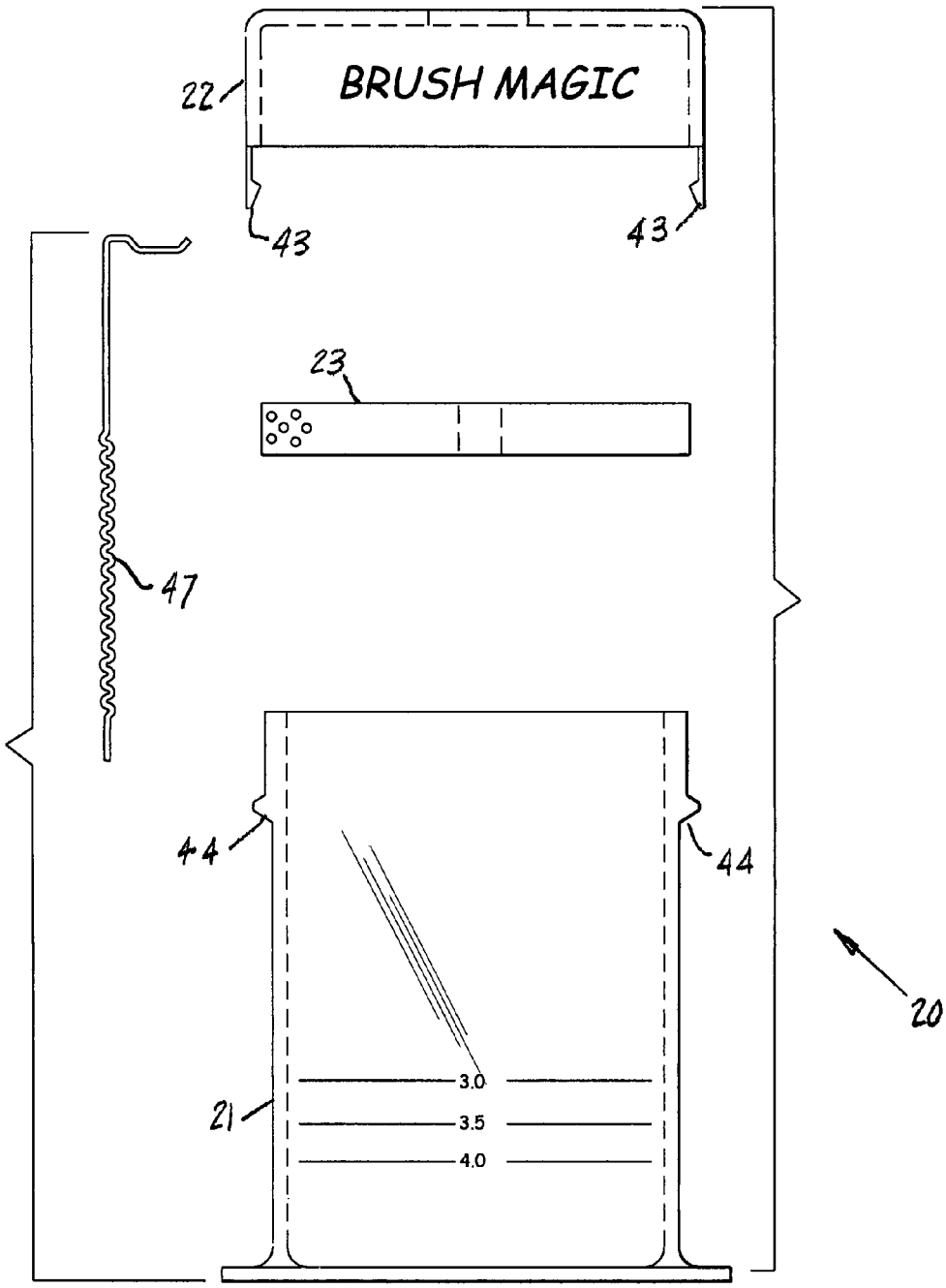
FIG. 7 is an exploded view of the paint brush holder.

With reference to FIGS. 1, 2 and 7, on opposite sides of the cover 22, a pair of resilient tabs 43 extend downwardly and fix the cover 22 to the housing 21 by engaging ribs 44 on the sides of the housing 21. When the cover 22 is pressed downwardly to engage the tabs 43, the portions of the gasket 23 which contact the upper edges 31 of the housing walls 26, 27, 29 compress to provide a tight seal. On the front of the housing 21 are optional graduation marks 45 that specify recommended levels of solvent for different size brushes.

The transparent housing 21 enables a user to properly position the brush 37 in the housing 21 whereby the bottom of the brush 37 is spaced above the bottom of the housing 21 and the bristles are spaced away from the walls 26, 27, 29 of the housing 21. As shown in FIG. 2, the brush 37 is positioned in the housing 21 to provide a reservoir 46 below the bristles for paint that has dropped from the brush With reference to FIGS. 1 through 3, the optional wire support post 47 extends from an upper portion of the handle 36 to the inside of the housing 21. The optional support post 47 that extends through the cover 22 and gasket 23 assists in maintaining the height and angle of the brush 37 relative to the housing 21. The height of the brush 37 is adjusted by raising and lowering the support post 47.

Figure 4:
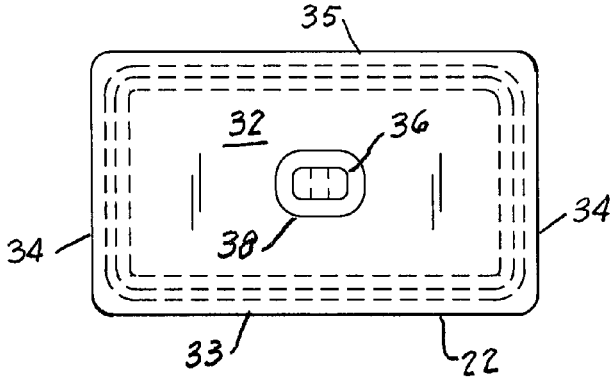
FIG. 4 is a plan view of a cover of the paint brush holder and the paint brush.
Figure 5:
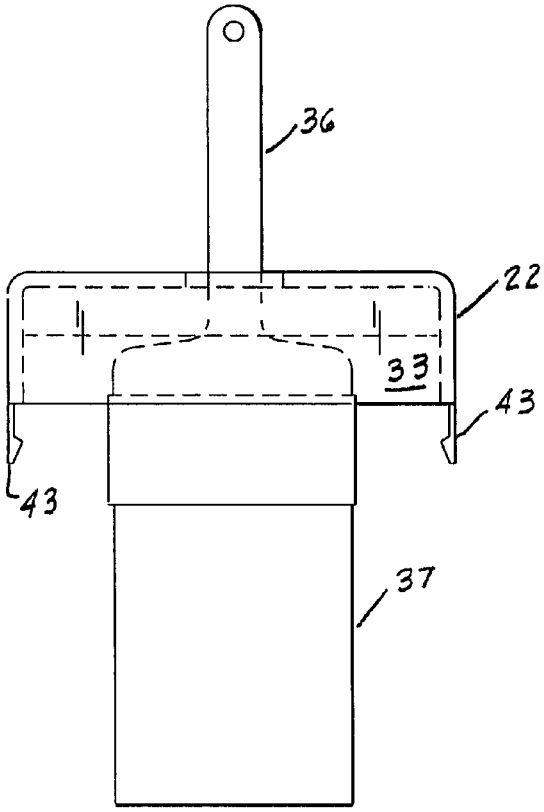
FIG. 5 is a front view of the cover and paint brush.
Figure 6:
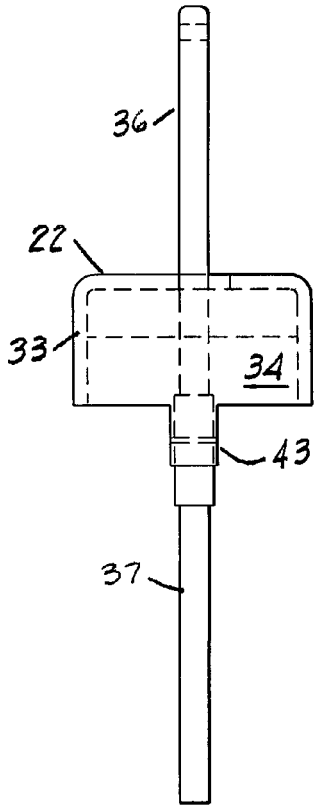
FIG. 6 is a left side view of the cover and paint brush.
Figure 10:
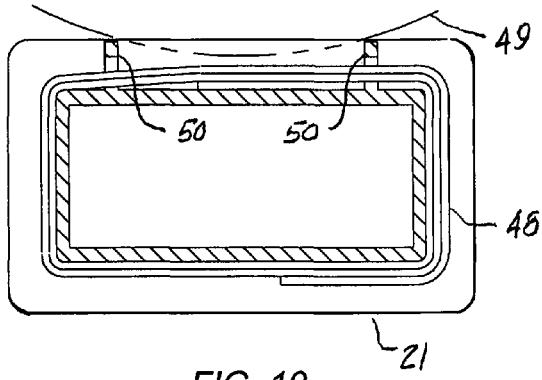
FIG. 10 is a cross-sectional view taken on the line 10-10 in FIG. 8.
Figure 8:
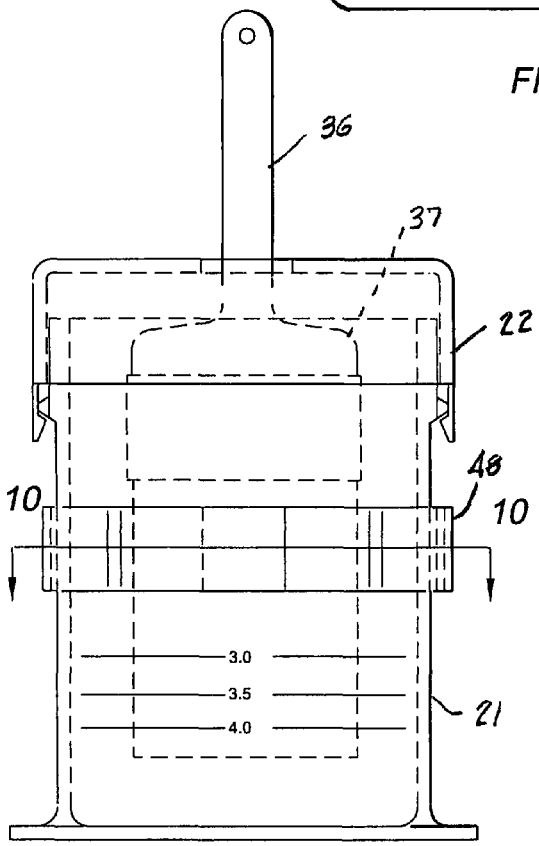
FIG. 8 is a plan view of the paint brush holder and paint brush with an optional strap for retaining the holder and paint brush on a paint can.
Figure 9:
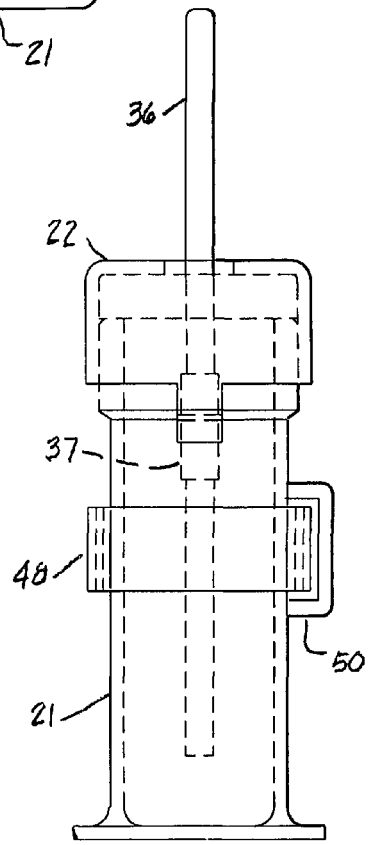
FIG. 9 is a left side view of the holder, brush and strap.

One use of the invention which is not readily apparent is to catch drippings during painting from a paint brush 37. This use is shown in FIGS. 4 through 6, wherein the cover 22 is mounted on the handle 36 and serves as a drip pan. As shown In FIGS. 8 through 10, an optional hook and loop fastener strap 48 may be provided for attaching the apparatus 20 to a side of a paint can 49. A pair of molded loops 50 on the housing 21 position the strap 48 on the housing 21.

The preferred method of using the invention is as follows. Excess paint is first removed by wiping a brush 37 against the side of a can. After the excess paint has been removed, the handle 36 of the brush 37 is inserted through the apertures 38, 39 of the cover 22 and gasket 23. Next, a cleaning solvent is added to an open housing 21 in an amount which brings the level of the solvent to the graduation 45 on the housing 21 that corresponds with the size of the brush 37. The cover 22 is then fixed to the housing 21 by pressing the cover 22 downwardly to compress the gasket 23 and engage the resilient tabs 43 of the cover 22 with the ribs 44 of the housing 21. The position of the brush 37 in the housing 21 is checked by viewing the brush 37 through the transparent housing 21 to confirm there is sufficient space below the bristles to capture paint and that the bristles of the brush 37 do not contact the walls 26, 27, 29 of the housing 21. Next, the cleaning device 20 is grasped and vigorously shaken for several minutes to wash the brush 37 with the solvent. The cleaning device 20 and enclosed brush 37 are placed on a horizontal surface such as the surface of a work bench or a tabletop. During the storage of the brush 37 in this manner, the interior of the housing becomes saturated with solvent vapor, causing a residue of paint which may exist to drop from the brush 37 to the space below the bristles. This method and device have been conducted in this manner with excellent results.

Figure 14:
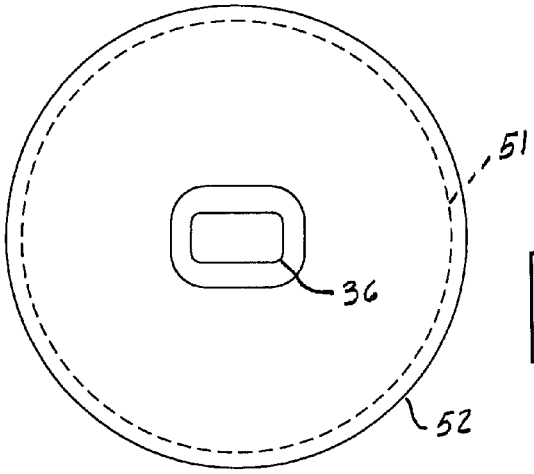
FIG. 14 is a plan view of a second alternate embodiment of the paint brush holder and paint brush.
Figure 15:
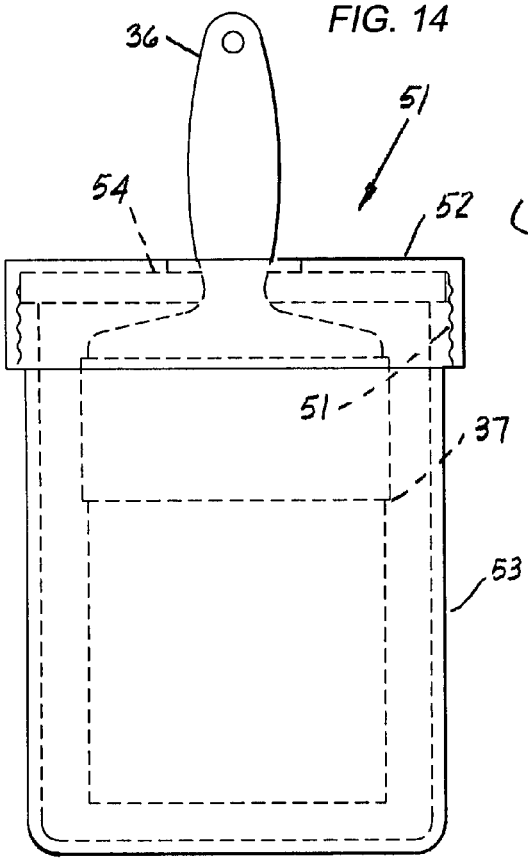
FIG. 15 is a front view of the second alternate embodiment and paint brush.
Figure 16:
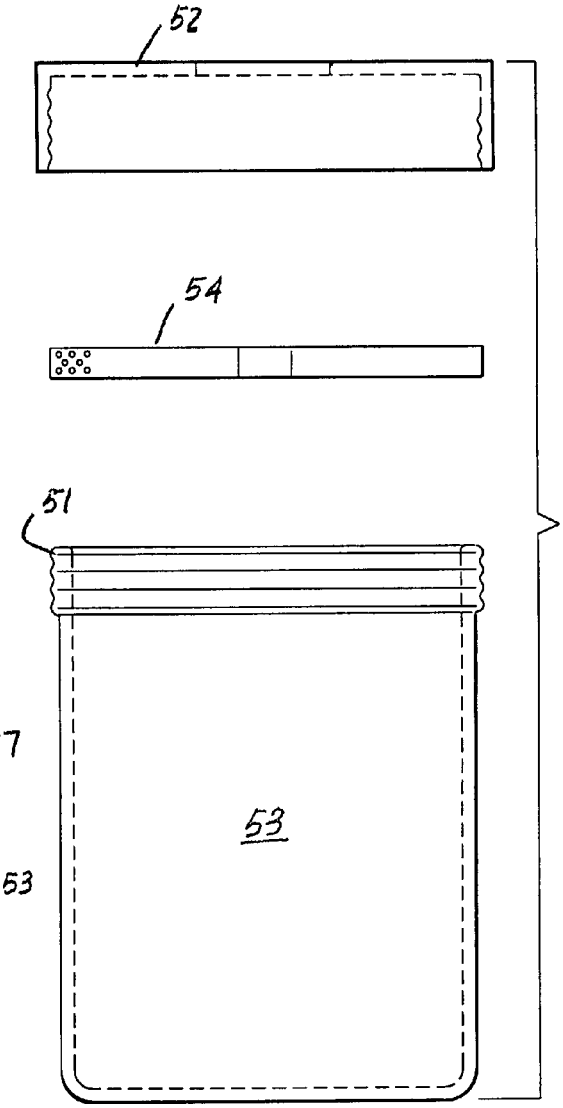
FIG. 16 is an exploded view of the second alternate embodiment and paint brush.
Figure 17:
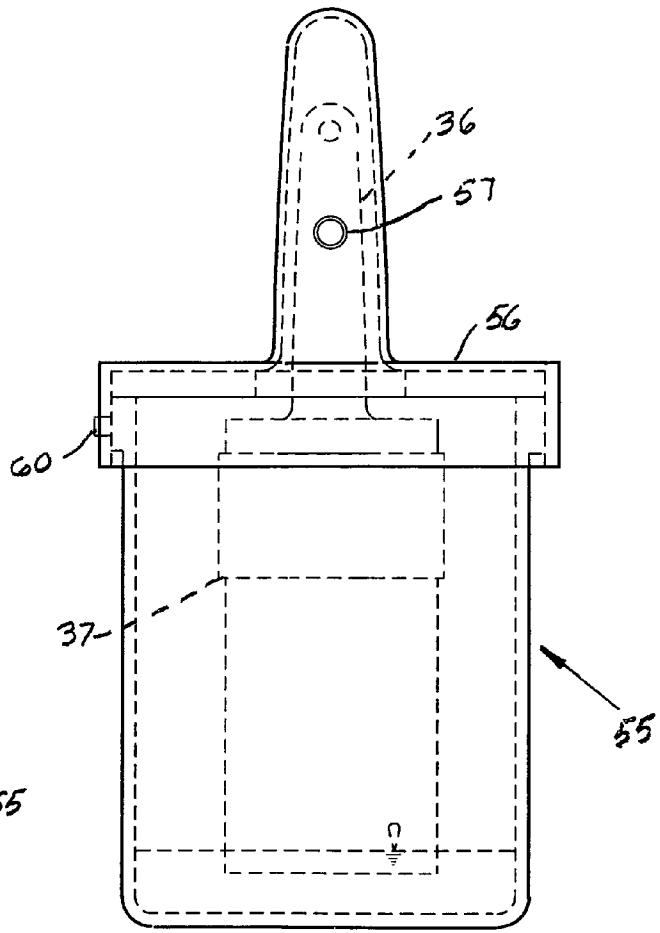
FIG. 17 is a front view of the second alternate embodiment and paint brush.
Figure 18:
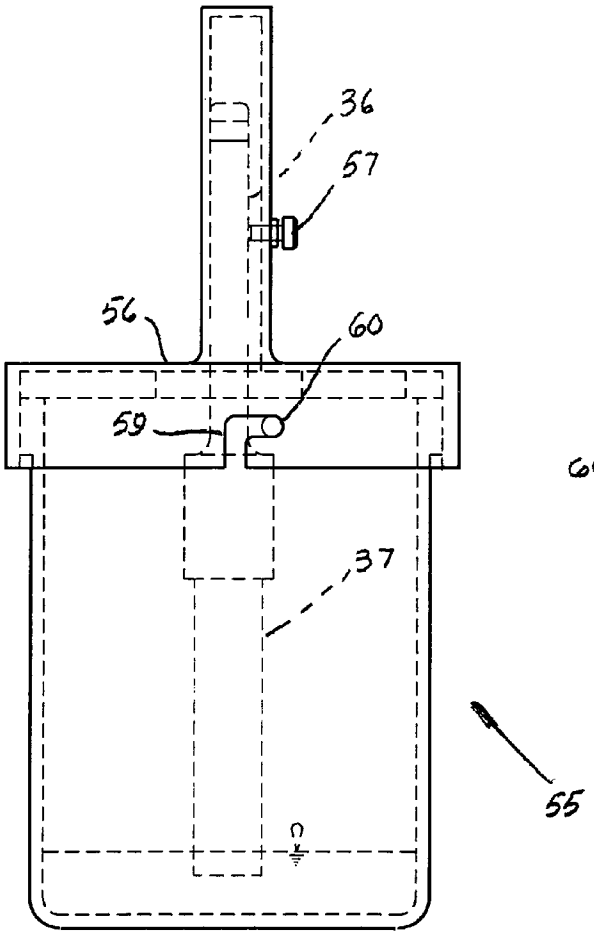
FIG. 18 is a right side view of the second alternate embodiment and paint brush.

In FIGS. 14 through 16 an embodiment 51 is shown wherein a cylindrical cover 52 is fixed to a cylindrical housing 53 by threadably engaging the cover 52 with the housing 53. During the fixing of the cover 52 to the housing 53, a thick circular gasket 54 made from a resilient cellular material is compressed. In FIGS. 17 and 18 an embodiment 55 is shown wherein the handle 36 of a brush 37 is totally enclosed in a cylindrical cover 56 and is positioned in the cover with a thumb screw 57. The cover 56 is fixed to a cylindrical housing 58 by engaging an inverted twist type "J-slot" 54 of the cover 56 with a small outwardly extending post 60 of the housing 58.

From the foregoing it is apparent that my invention provides a means for cleaning and preserving a paint brush with many important advantages and benefits over the prior art. A characterizing feature of my invention is that a resilient horizontal gasket is used in place of the numerous arrangements in the prior art that are costly, difficult to use and difficult to seal. Other important benefits are that it prevents toxic solvent vapors from being discharged into the environment, removes the drudgery of cleaning paint brushes, reduces the use of cleaning solvents and preserves the quality of paint brushes.

Although only several embodiments of my invention have been illustrated and described, it will be appreciated that other embodiments can be derived by such obvious changes such as substitutions of parts, changes in the arrangements of parts, inversions of parts, integrations of parts and changes in materials known to persons skilled in the relevant arts.

What I claim is new is:

1. In combination with a paint brush and a hazardous vapor emitting liquid, a housing for storing said hazardous vapor emitting liquid, cleaning said paint brush and preventing a discharge of said hazardous liquid and vapor into the environment, said housing having an open top portion, a bottom wall and vertical front, side and rear walls, said vertical walls having upper sealing edges lying in a common horizontal plane; a cover in sealing relationship with said sealing edges of said housing, said cover having an aperture for extending a handle of said paint brush outwardly into the exterior of said housing; a thick resilient compressible gasket between said cover and said upper edges of said vertical walls of said housing, said gasket extending across said cover and having an aperture aligned with said aperture of said cover in tight fitting sealing relationship with said handle for concurrently suspending said brush downwardly into said housing, sealing said cover in said housing and sealing said handle in said cover to prevent loss of said vapor emitting fluid and said hazardous vapor from said housing; and a means for fixing said cover to said housing.

2. The apparatus recited in claim 1 wherein said gasket is a uniform thickness layer of a resilient closed cell polymer.

3. The apparatus recited in claim 2 wherein said resilient closed cell polymer is a cross-linked closed cell polyethylene.

4. The apparatus recited in claim 1 wherein said one-piece compressible gasket is said single unitary means for concurrently establishing said sealing relationship of said cover to said housing, sealing said handle in said cover and suspending said brush from said cover.

5. The apparatus recited in claim 1 wherein said means for fixing said cover to said housing comprises an inverted "J-slot" in said cover and a small outward extending post on said housing.

6. The apparatus recited in claim 1 further comprising a means for mounting said apparatus on a side of a paint can, said means comprising a hook and loop strap and a pair of loops on a housing for positioning said strap on said housing.

7. The apparatus recited in claim 1 further comprising a vertical wire support extending through said cover and said gasket for maintaining the height and angle of a brush relative to said housing.

8. The apparatus recited in claim 1 wherein said housing is a generally rectangular shaped housing.

9. The apparatus recited in claim 1 wherein said housing is a generally cylindrical shaped housing.

10. The apparatus recited in claim 1 wherein said bottom wall of said housing has a short outward extending flange.

11. The apparatus recited in claim 1 wherein said housing is transparent.

12. The apparatus recited in claim 11 wherein said housing has indicia for establishing fluid levels in said housing.

* * * * *